US007150685B1

(12) United States Patent
Berokoff

(10) Patent No.: US 7,150,685 B1
(45) Date of Patent: Dec. 19, 2006

(54) GOLF CLUB

(76) Inventor: Andrew J. Berokoff, 13922 Valna Ave., Whittier, CA (US) 90605

( * ) Notice: Subject to any disclaimer, the term of this patent is extended or adjusted under 35 U.S.C. 154(b) by 0 days.

(21) Appl. No.: 10/799,124

(22) Filed: Mar. 15, 2004

(51) Int. Cl.
*A63B 53/16* (2006.01)

(52) U.S. Cl. ..... 473/294; 473/295; 473/296

(58) Field of Classification Search ..... 473/294–296, 473/300, 303, 298, 299, 244, 201, 219, 226, 473/231, 256
See application file for complete search history.

(56) References Cited

U.S. PATENT DOCUMENTS

| | | | | | |
|---|---|---|---|---|---|
| 1,305,952 | A * | 6/1919 | Suesman | ..... | 473/295 |
| 1,419,795 | A | 6/1922 | Yerger | | |
| 1,975,341 | A * | 10/1934 | Young | ..... | 473/340 |
| 2,984,486 | A | 5/1961 | Jones | ..... | 273/72 |
| 3,837,647 | A | 9/1974 | Jacques | ..... | 273/81 |
| 5,042,804 | A | 8/1991 | Uke et al. | ..... | 273/75 |
| 5,413,339 | A * | 5/1995 | Martin | ..... | 473/295 |
| 5,611,533 | A | 3/1997 | Williams | ..... | 473/568 |
| 5,634,859 | A * | 6/1997 | Nesbitt | ..... | 473/301 |
| 5,686,158 | A * | 11/1997 | Gibbon | ..... | 428/36.92 |
| 5,749,792 | A * | 5/1998 | Engfer et al. | ..... | 473/300 |
| 5,944,618 | A * | 8/1999 | Cheng | ..... | 473/319 |
| 6,599,200 | B1 * | 7/2003 | Kallassy | ..... | 473/204 |
| 2002/0025860 | A1 * | 2/2002 | Sosin | ..... | 473/340 |
| 2005/0197201 | A1 * | 9/2005 | Schoeninger | ..... | 473/300 |

FOREIGN PATENT DOCUMENTS

| | | |
|---|---|---|
| JP | 2001-310002 | * 11/2001 |
| JP | 2003-79776 | * 3/2003 |

* cited by examiner

*Primary Examiner*—Stephen Blau
(74) *Attorney, Agent, or Firm*—Kenneth L. Green; Edgar W. Averill, Jr.

(57) ABSTRACT

An improved golf club includes an improved grip. The grip may be improved over known grips by including an offset upper portion and/or a sliding grip portion, and/or by providing a shaft with greater flex in an upper shaft portion than in a lower shaft portion. The sliding grip portion is about four inch long and may slide over a standard grip, or over a guide, and is preferably used with putters, but may be used with other golf clubs. The offset upper portion comprises an eleven inch upper grip offset at about nine degrees from the shaft centerline and clocked about 110 degrees counter-clockwise from that face of the head. The lower portion of the grip is retained as in known clubs.

16 Claims, 6 Drawing Sheets

GOLF CLUB

BACKGROUND OF THE INVENTION

The present invention relates to a golf club, and more particularly to a golf club having an improved grip and shaft.

Many golfers have difficulty in developing and maintaining their swing. Playing well requires a consistent swing, and both effort and discomfort reduce consistency. For example, when hitting a ball, a golfer must have good timing to "follow through" not only with arm motion, but with the shoulder motion. The requirement to combine such motion makes consistency all the more difficult. Further, many beginning golfers have extensive experience playing baseball, and are accustomed to a baseball swing and baseball grip. Known golf clubs are not suitable to such baseball swing and grip, and thus golfers are unable to make optimal use of the skeletal, neurological and muscular parts of the body.

What is needed are golf club grips which make it easier to improve timing to follow through with the shoulders, and all parts of the body. A sliding grip and/or a baseball grip and swing, will help the whole body to achieve better timing when the club-head makes impact on the ball.

BRIEF SUMMARY OF THE INVENTION

The present invention addresses the above and other needs by providing a golf club which includes an improved grip. The grip may be improved over known grips by including an offset upper portion and/or a sliding grip portion, and/or by providing a shaft with greater flex in an upper shaft portion than in a lower shaft portion. The sliding grip portion is preferably about four inches long and may slide over or rotate clockwise or counter-clockwise around a standard grip or over a guide, and is preferably used with putters, but may be used with other golf clubs such as woods or irons. The offset upper portion defines an approximately eleven inch long upper grip offset at between about two degrees and about twenty degrees from the shaft centerline, and preferably offset about nine degrees. The offset upper portion is preferably clocked between about ninety two degrees and about one hundred and ten degrees counter-clockwise relative to the face of the head, and more preferably about ninety five degrees counter-clockwise relative to the face of the head. Below the grip portion of irons and woods, the shaft may be made to have smaller diameter, thinner material, or different internal structure than the lower shaft portion, to increase the relative flex of the upper shaft portion, and the upper shaft portion preferably has twice the flex of the lower shaft portion.

In accordance with one aspect of the invention, there is provided an improved golf club comprising a grip, a shaft, a head, and a sliding grip portion adapted to slide on the grip or on a guide or adapted to rotate around the grip or the guide. In one embodiment the sliding grip portion may be limited to slide on an upper grip portion by an upper stop and a lower stop. The sliding grip portion may or may not be keyed to the grip to prevent rotation.

In accordance with another aspect of the present invention, there is provided an improved golf club comprising a head, a shaft, a grip, and an angularly offset upper grip. The angularly offset upper grip may be permanently or removably attached to the grip, and may be between six and twelve inches long. The angle between a grip centerline and a centerline of the angularly offset upper grip is between two degrees and twenty degrees, and the angularly offset upper grip is clocked counter-clockwise between approximately ninety two degrees and approximately one hundred and ten degrees from a face of the head. A golf club having a angularly offset upper grip may be include a sliding grip portion.

In accordance with still another aspect of the invention directed to irons or woods, there is provided an improved golf club with a shaft having an upper shaft portion with about twice the flex of a lower shaft portion. The desired flex may be obtained by tapering the shaft, by incorporating thicker material into the lower shaft portion, by including internal structure in the lower shaft portion, or a combination of taper, thickness, and internal structure.

In accordance with an additional aspect of the present invention, there is provided a method for using a putter with a sliding upper grip portion. From the point of view of a right handed player. The method comprises grasping the putter with a cross-handed grip (the left hand grasps the grip on or below a stop, or below the sliding grip, and the right hand grasps the sliding grip above the left hand). The player addresses a ball, points the leading left elbow in the desired direction of the ball, and executes a backstroke. He then swings the club towards the ball, and when the club hits the ball, he uses the right hand to pull the sliding grip away from the lower stop, and completes the swing with the follow through by the right shoulder.

In accordance with another aspect of the present invention, there is provided a method for using a golf club with an angularly offset upper grip portion. The method comprises grasping the angularly offset upper grip with a normal baseball grip, addressing a ball, pointing the leading elbow in the desired direction of the ball, executing a backstroke, swinging the club towards the ball, hitting the ball, and completing the swing.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
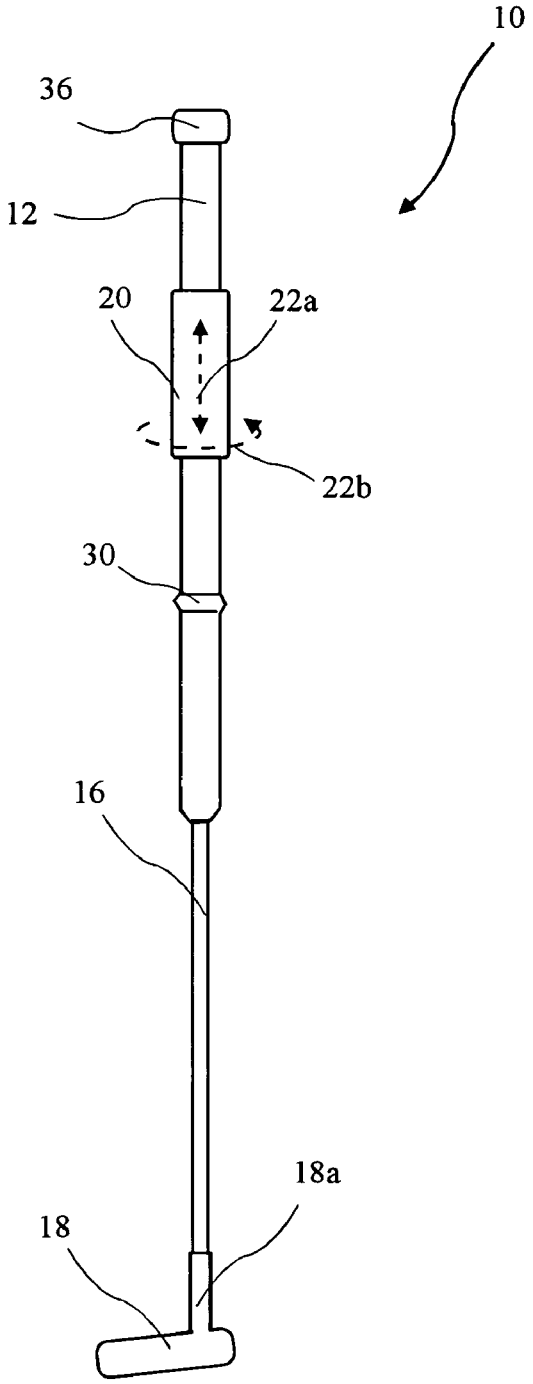
FIG. 1 shows a golf club with a sliding grip portion.
Figure 2:
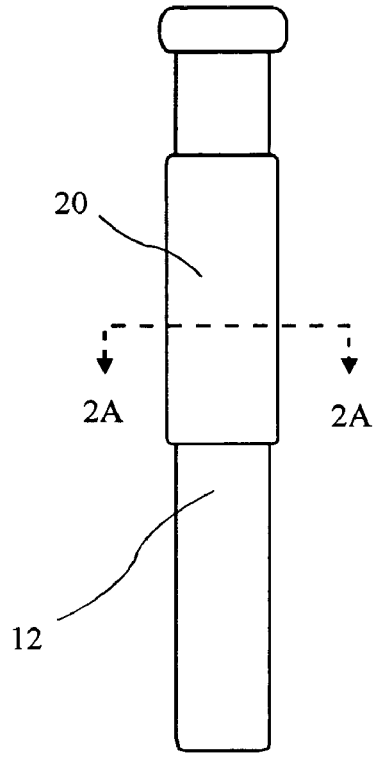
FIG. 2 shows details of the sliding grip portion.
Figure 2A:
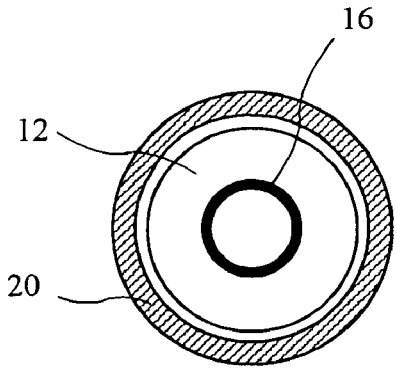
FIG. 2A depicts a cross-sectional view taken along line 2A—2A of FIG. 2 of the cooperation of the sliding grip portion with a guide.

A golf club 10 with a grip 12 is shown in FIG. 1. A shaft 16 extends from the grip 12 to a head 18 suitable for hitting a golf ball. A sliding grip portion 20 slides over the grip 12 as shown by arrow 22 and may rotate about the grip 12. The lower end of the grip 12 can extend anywhere down the shaft 16 to within fourteen inches of a shank 18*a* of the head 18. The sliding grip portion 20 is preferably between approximately three and one half inches long to approximately four and one half inches long, and more preferably approximately four inches long. Further, the sliding grip portion 20 is preferably between approximately one inch in diameter to approximately one and one quarter inches in diameter, and more preferably approximately one inch in diameter, and is preferably approximately one sixteenth inch thick. The sliding grip portion 20 may slide along the grip 12 as shown by arrow 22*a* and rotate about the grip 12 as shown by arrow 22*b*, which sliding is limited by a stop 30. The stop 30 is preferably generally about eighteen inches above the shank 18*a* to accommodate a male player of average height, and in a particular embodiment of the golf club 10 well suited for fairway irons an woods, the stop 30 is about ten inches below a grip upper end 36. A detailed view of the grip 12 is shown in FIG. 2. A cross-sectional view of the grip 12 and sliding grip portion 20 taken along line 2A—2A of FIG. 2 is shown in FIG. 2A.

Figure 3:
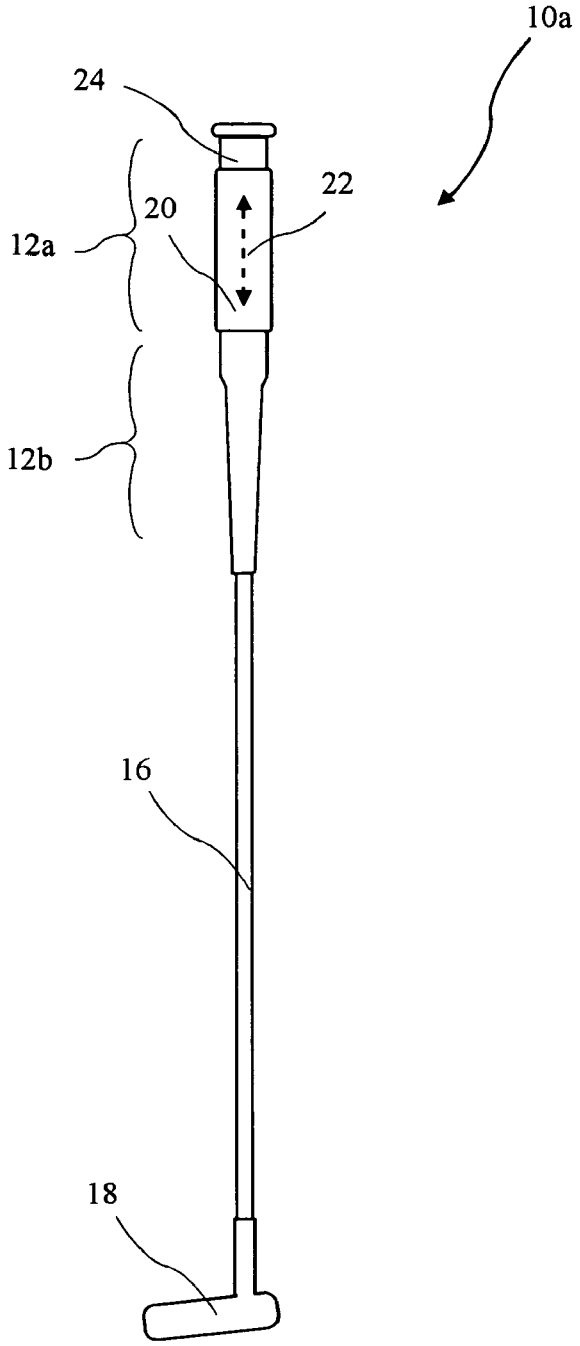
FIG. 3 shows a golf club with a sliding upper grip.

Another embodiment of the present invention is shown by golf club 10*a* including the sliding grip portion 20 in FIG. 3. The club 10*a* includes an upper grip portion 12*a* comprising a guide 24, and a lower grip portion 12*b*. The sliding grip portion 20 travels along the guide 24 as indicated by arrow 22, wherein the travel is preferably approximately two inches to approximately three inches, and more preferably approximately two inches. The lower grip portion 12*b* is preferably between approximately one half inch and one and one quarter inches in diameter, and more preferably approximately one inch in diameter, and may be constant diameter or tapered.

Figure 4:
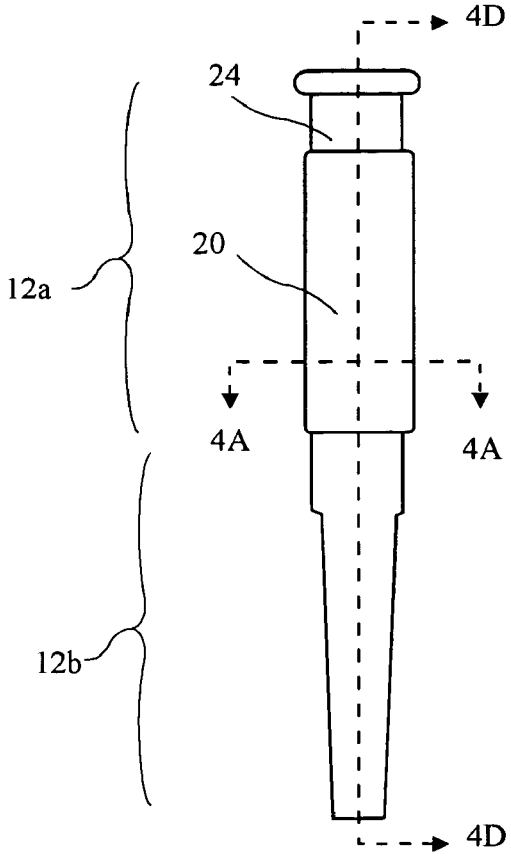
FIG. 4 shows details of the sliding upper grip.
Figure 4A:
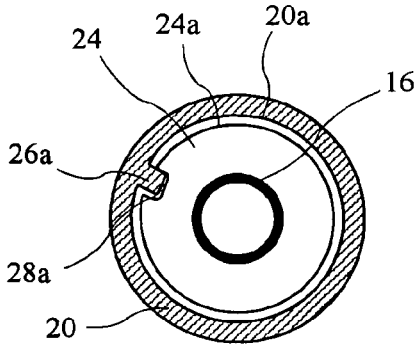
FIG. 4A depicts a cross-sectional view taken along line 4A—4A of FIG. 4 of the cooperation of the sliding upper grip with a guide, wherein a key defined by the sliding upper grip cooperates with a keyway defined by the guide.

A more detailed view of the grip portions 12*a*, 12*b* are shown in FIG. 4. The guide 24 is preferably constant diameter, and preferably approximately six and one quarter inches in length. A cross-sectional view taken along line 4A—4A of FIG. 4, showing a cooperation of the sliding grip portion 20 with the guide 24, is shown in FIG. 4A. The guide 24 includes a first keyway 28*a*, and the sliding grip portion 20 includes a first key 26*a*. The key 26*a* cooperates with the keyway 28*a* to prevent rotation of the sliding grip portion 20 relative to the guide 24. The sliding grip portion 20 includes a smooth inner surface 20*a* and the guide 24 includes a smooth outer surface 24*a* to facilitate sliding the sliding grip portion 20 on the guide 24.

Figure 4B:
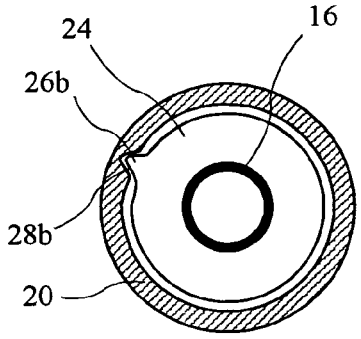
FIG. 4B depicts a cross-sectional view taken along line 4A—4A of FIG. 4 of the cooperation of the sliding upper grip with a guide, wherein a keyway defined by the sliding upper grip cooperates with a key defined by the guide.

A second cross-sectional view taken along line 4A—4A of FIG. 4, showing a cooperation of the sliding grip portion 20 with the guide 24, is shown in FIG. 4B, wherein the sliding grip portion 20 defines a second keyway 28*b*, and the guide 24 defines a second key 26*b*.

Figure 4C:
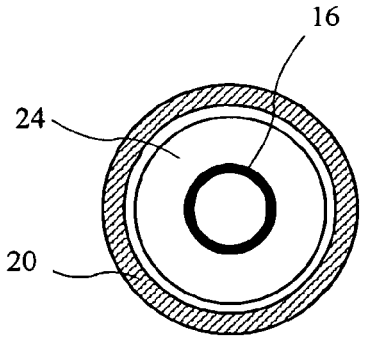
FIG. 4C depicts a cross-sectional view taken along line 4A—4A of FIG. 4 of the cooperation of the sliding upper grip with a guide, wherein the sliding upper grip is free to rotate about the guide.

A third cross-sectional view taken along line 4A—4A of FIG. 4, showing a cooperation of the sliding grip portion 20 with the guide 24, is shown in FIG. 4C, wherein the sliding grip portion 20 is free to rotate about the guide 24.

Figure 4D:
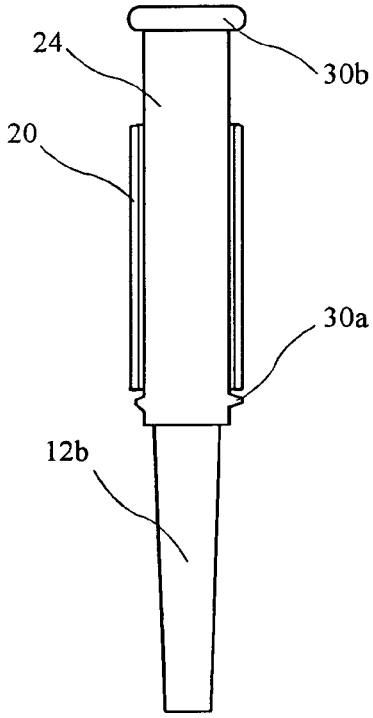
FIG. 4D depicts a cross-sectional view taken along line 4D—4D of FIG. 4 of the cooperation of the sliding upper grip with a guide, wherein the guide includes an upper stop and a lower stop to limit the extent of motion of the sliding upper grip.

A cross-sectional view taken along line 4D—4D of FIG. 4, showing a cooperation of the sliding grip portion 20 with the guide 24, is shown in FIG. 4D. Upper stop 30*b* and lower stop 30*a* are defined on the guide 24, which stops 30*a*, 30*b* limit the travel of the sliding grip portion 20 on the guide 24. The stops 30*a*, 30*b* are preferably between approximately 1/16 and approximately 1/32 of an inch high, and preferably resemble a bead of weld. Although the embodiment described in FIGS. 3 and 4 includes a guide 24, the sliding grip may also slide over an existing grip 12. The sliding grip portion 20 may be used with a variety of golf clubs, for example, a putter, long and short irons, and woods.

Figure 5:
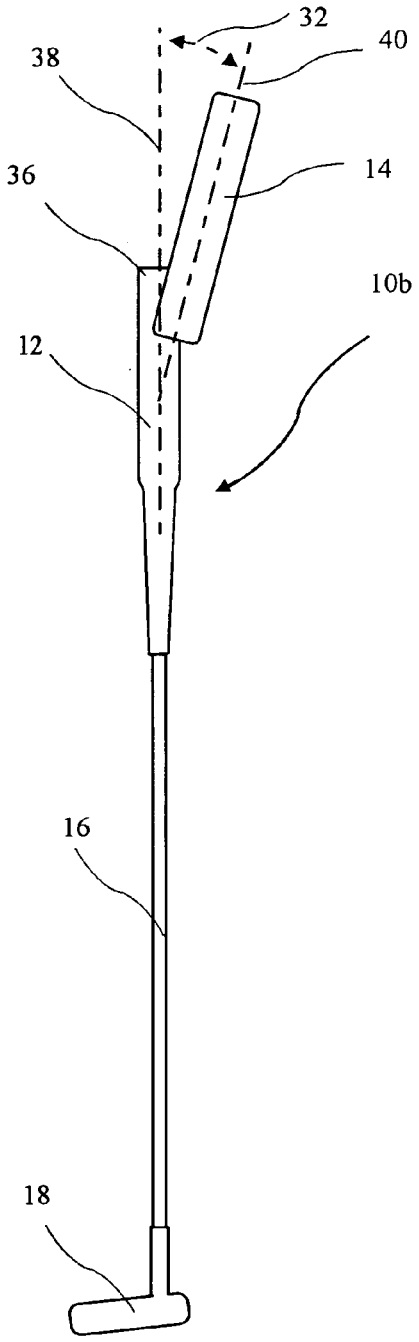
FIG. 5 shows a front view of a golf club with an angularly offset upper grip.

Yet another embodiment of the present invention is shown by golf club 10*b* including an angularly offset upper grip 14 as shown in FIG. 5 The angularly offset upper grip 14 is preferably between approximately five eighths inches and approximately one and one half inches in diameter and more preferably one inch in diameter, and is preferable between approximately eight inches and approximately twelve inches long, and more preferably approximately eleven inches long and preferably extends approximately eight inches beyond the grip upper end 36.

The offset upper grip 14 is attached to the grip 12 near the grip upper end 36, and a centerline 40 of the offset grip 14 is offset by angle 32 from the centerline 34 of the shaft 16. The angle 32 is preferably between approximately two degrees and approximately twenty degrees, and is more preferably approximately nine degrees. The offset grip centerline 40 preferably intersects the shaft centerline 38 between approximately two inches to approximately four inches from the grip upper end 36, and more preferably approximately three inches from the grip upper end 36.

The offset upper grip 14 may be permanently attached to the grip 12, or be a removable offset upper grip 14 thereby allowing the offset upper grip 14 to be switched between clubs, or removed to allow easier storage of clubs.

Figure 5A:
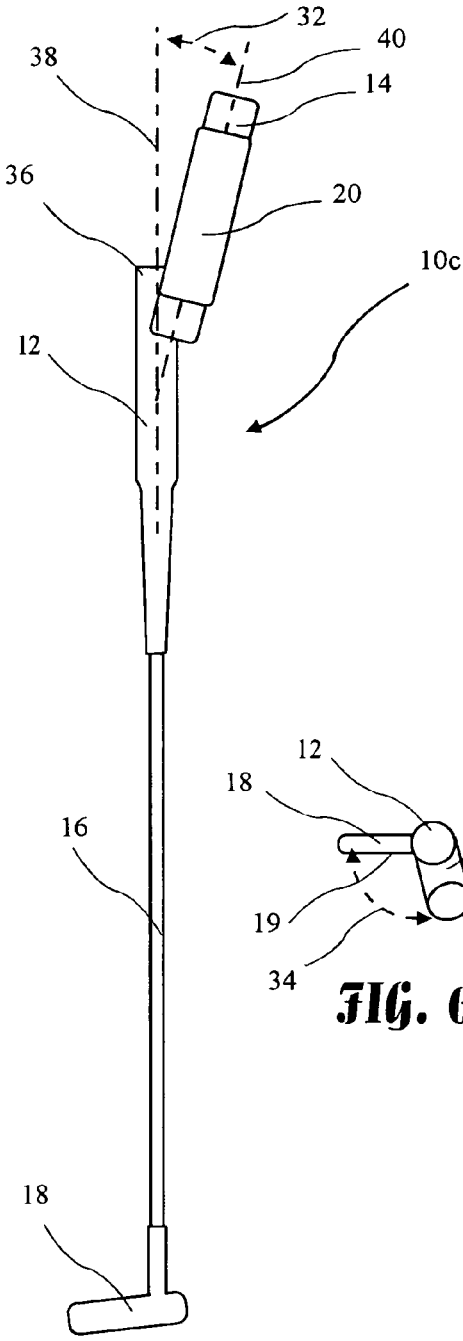
FIG. 5A shows a front view of a golf club with the angularly offset upper grip and the sliding grip portion.

A golf club 10*c* having both the offset upper grip 14 and the sliding grip portion 20 is shown in FIG. 5A. The sliding grip portion 20 may slide on the offset upper grip 14, or on the grip 12.

Figure 6:
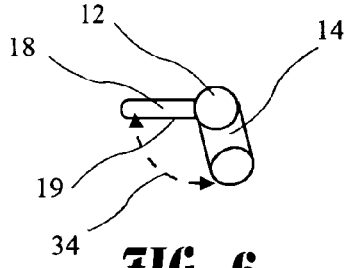
FIG. 6 shows a top view of the golf club with an angularly offset upper grip.

A top view of the club 10*b* is shown in FIG. 6. The offset upper grip 14 is clocked counter-clockwise by a clocking 34, from face 19 of head 18. The clocking 34 is preferably between approximately ninety two degrees and approximately one hundred and ten degrees from the face 19, and more preferably approximately ninety five degrees.

The grip 12 of the golf club 10*b* may be a standard grip as used on known golf clubs, or may be between nine and ten inches long, have a width between one half inch and one and one quarter inches and preferably one inch, and may be constant width.

Figure 7:
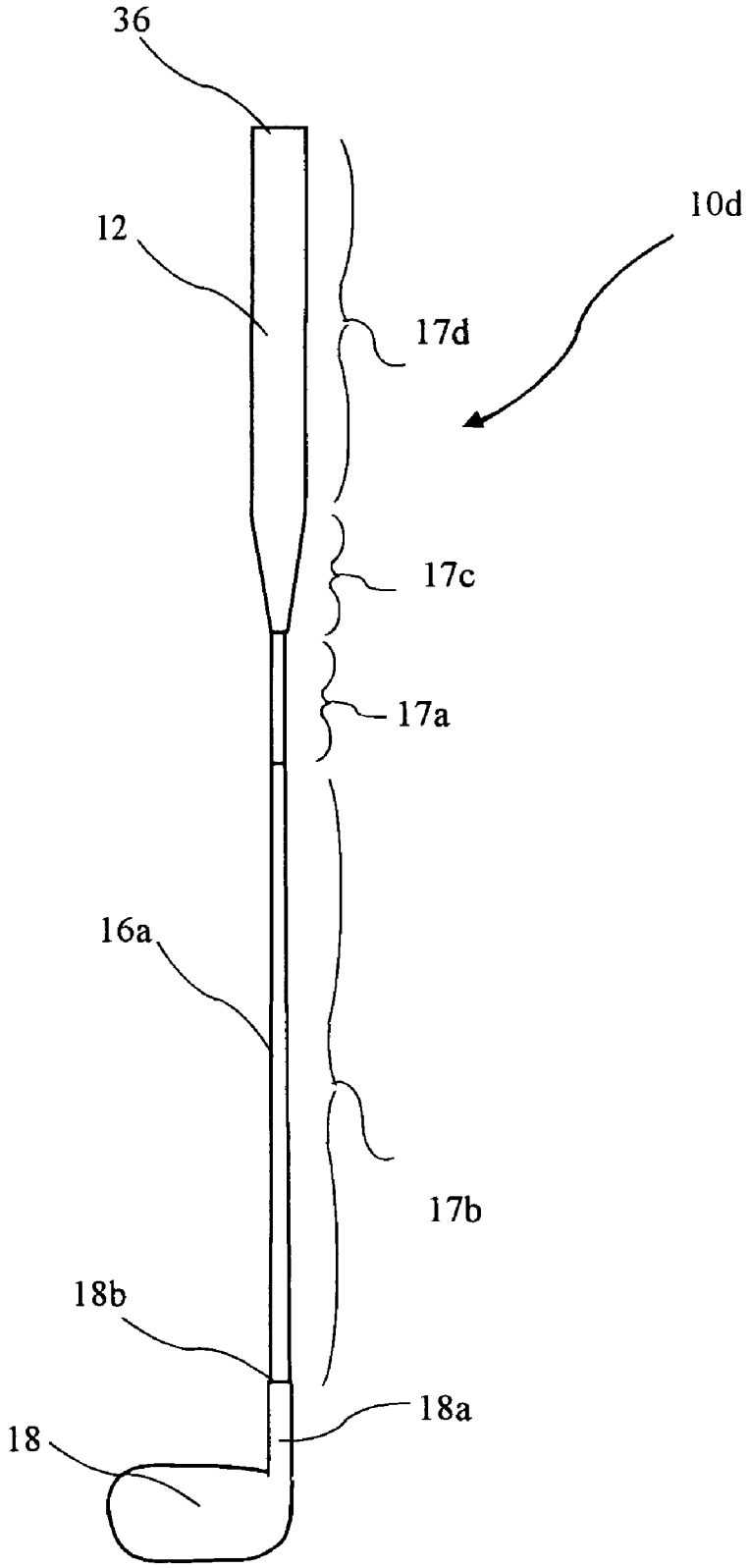
FIG. 7 shows a front view of a golf club with a shaft adapted to provide greater flex in an upper shaft portion than in a lower shaft portion.

A golf club 10*d*, preferably an iron or wood, with a second shaft 16*a* having an upper shaft portion 17*a* with greater flex, and preferably twice the flex, of a lower shaft portion 17*b* is shown in FIG. 7. The desired flex may be obtained by tapering the shaft 16*a*, by incorporating thicker material into the lower shaft portion 17*b*, by including internal structure in the lower shaft portion 17*b*, or a combination of taper, thickness, and internal structure. The shaft 16*a* may be fabricated with the desired flex, or may be modified after fabrication by fusing additional material, for example metal, fiber-glass, or the like, onto or into the lower shaft portion 17*b*. For example, an aluminum tube may be fused between the shank 18*a* and a point about twenty inches below the shaft top. As another example, a half tube (i.e., a tube split length-wise) may be fused to one side of the shaft 16*b* from the shank 18*a* to a point about twenty inches below the shaft top.

Preferably, the greater flex of the upper shaft portion 17*a* is obtained by tapering the shaft 16*a*, wherein the shaft 16*a* tapers from its widest diameter at a junction 18*b* with the shank 18*a*, to its narrowest diameter, preferably at a point twelve to twenty inches below the grip upper end 36. The narrowest diameter of the shaft 16*a* is more preferably at the upper shaft portion 17*a* which is about three inches in length and located between fourteen inches and sixteen inches below the grip upper end 36. A tapered grip portion 17*c* extends from the upper shaft portion 17*a* to within about ten inches of the grip upper end 36, wherein a straight grip portion 17*d* extends from the tapered grip portion 17*c* to the grip upper end 36, which straight grip portion 17*c* is preferably approximately one inch in diameter. The lower shaft portion 17*b* preferably reduces in diameter between the shank junction 18*b* (largest diameter) to the upper shaft portion 17*a* (smallest diameter), and the upper shaft portion 17*a* preferably has approximately the same diameter as the smallest diameter of the lower shaft portion 17*b*.

An embodiment of the golf club 10 of FIG. 1 in which the sliding grip portion 20 is not keyed (i.e., can rotate about the grip 12 or guide 24), and the stopper 30 is about ten inches below the grip upper end 36, is used by a right handed player as follows. Upon addressing the ball, there is no cross-handed placement of the hands. This means that the left hand is positioned on the highest portion of the grip 12, and the right hand is placed on the moving grip portion 20 below the left hand. There is no interlocking of the two hands and no interlocking of the fingers of the two hands. It is essential that the two hands will function somewhat independently. The left hand grasps the grip 12 firmly, and the right hand grasps the sliding grip portion 20 less firmly. When the club is taken back primarily by the left side of the body, and left arm and hand, the right hand on the sliding grip portion 20 may or may not fractionally slide up toward the left hand, and may or may not rotate fractionally counter-clockwise until the hands cock over the right shoulder to be ready for the return downswing. On the return downswing, the force is primarily from the left side of the body, and arm and hand, but at the point of impact with the ball, the right hand on the sliding grip portion 20 deliberately should be fractionally rotated clockwise. This action by the right hand will help eliminate the common trend of players to tighten the right hand on their club's grip at the point of impact, a tendency which distorts the timing and the hitting surface off the club's alignment to the direction intended.

Figure 8:
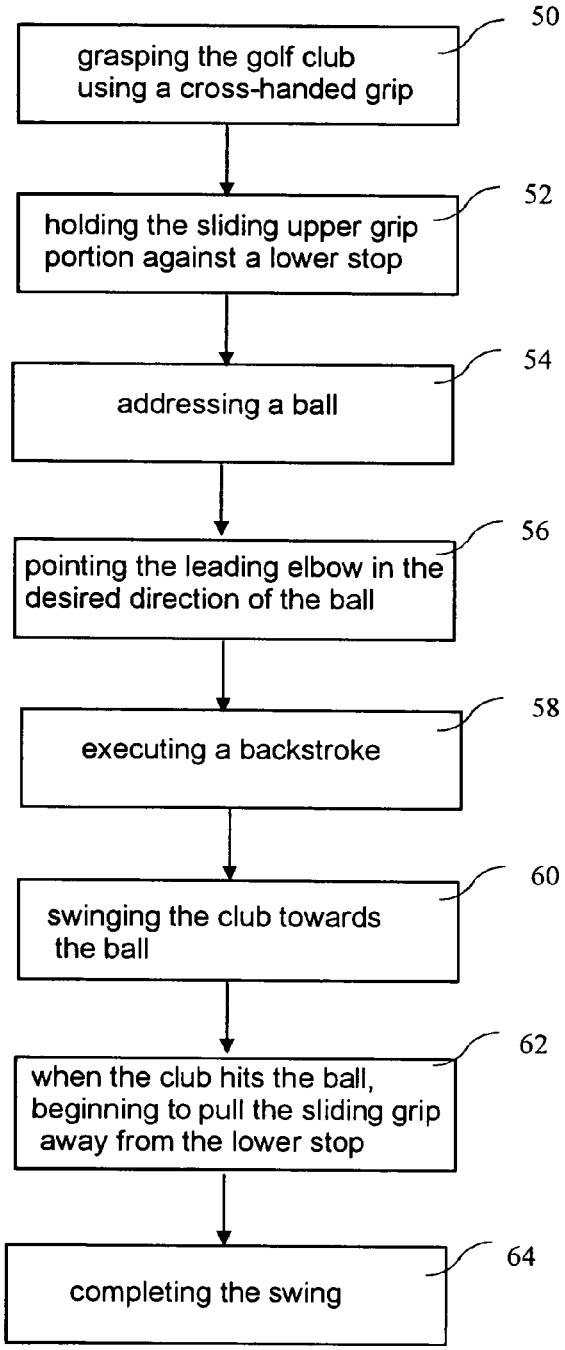
FIG. 8 depicts a method of use of a golf club with a sliding grip.

A method for using a putter with a sliding upper grip portion to create a lag stroke is described in FIG. 8. The sliding grip provides numerous options for performing the lag stroke, and the following is a preferred option. The left arm and left side of the body provide the power for the lag stroke. The method comprises grasping the putter using a cross-handed grip at step 50. A cross handed grip for a right handed golfer would place the golfer's right hand on the sliding grip portion and the left hand on the stationary lower grip portion. The method further includes holding the sliding grip portion with the right hand against a lower stop at step 52, addressing a ball at step 54, pointing the leading elbow in the desired direction of the ball at step 56, executing a backstroke at step 58, swinging the club towards the ball at step 60, when the club hits the ball, beginning to pull the sliding grip away as vertically as possible from the lower stop at step 62, and completing the swing with minumim shoulder follow-through at step 64.

Figure 9:
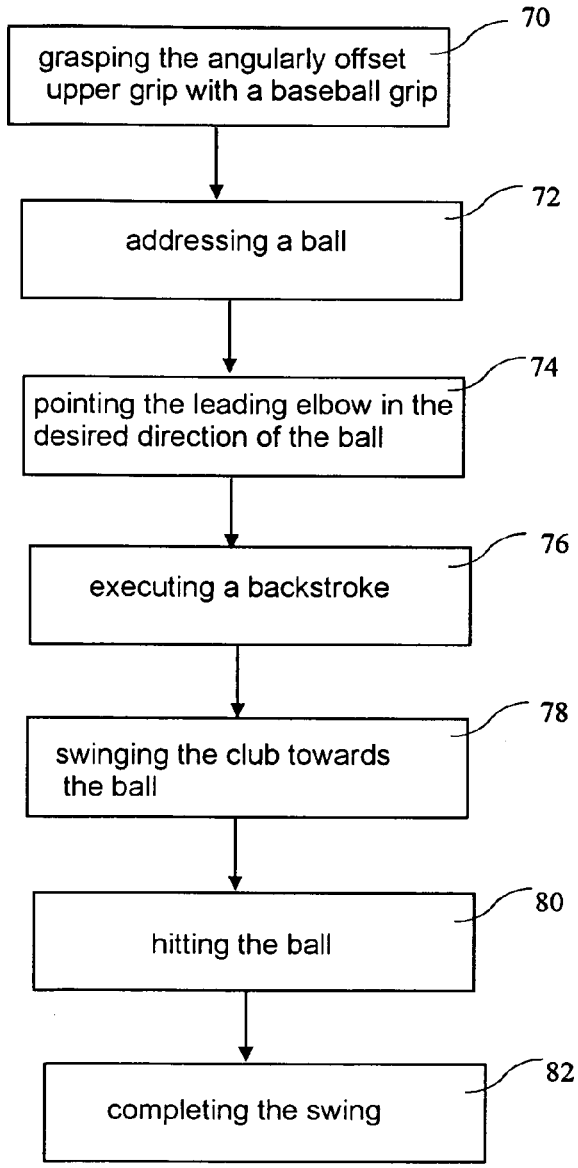
FIG. 9 depicts a method of use of a golf club with an angularly offset grip.

A method for using a golf club with an angularly offset grip portion is described in FIG. 9. The method comprises grasping the angularly offset upper grip using a normal baseball grip at step 70, addressing the ball at step 72, pointing the leading elbow in the desired direction of the ball at step 74, executing a backstroke wherein the left arm is pushing and the right arm is pulling the club back and around the right shoulder whereby the right hand and the left hand will be "cocked" at the top of the backstroke at step 76, swinging the club towards the ball with the left side of the body, left arm, and left hand leading at step 78, hitting the ball at 80, and completing the swing a at step 82.

Those parameters which are opposite for right versus left hand players have been provided above for a right handed player, and the scope of the present invention is intended to include the corresponding values for a left handed player.

While the invention herein disclosed has been described by means of specific embodiments and applications thereof, numerous modifications and variations could be made thereto by those skilled in the art without departing from the scope of the invention set forth in the claims.

I claim:

1. An improved golf club comprising:

a head;

a grip having a lower grip portion and an upper grip portion;

the upper grip portion including an upper stop and a lower stop;

a shaft connecting the grip to the head; and a sliding grip portion adapted to slide on the grip, the sliding grip portion limited by the upper stop and the lower stop to a travel of approximately two inches to approximately three inches.

2. The golf club of claim 1, wherein the sliding of the sliding grip portion is limited by the upper stop and the lower stop a travel of approximately two inches.

3. The golf club of claim 1, wherein the sliding grip portion is between approximately three and one half inches long to approximately four and one half inches long.

4. The golf club of claim 1, wherein the sliding grip portion is approximately four inches long.

5. The golf club of claim 1, wherein the sliding grip portion is between approximately one inch in diameter to approximately one and one quarter inches in diameter.

6. The golf club of claim 1, wherein the sliding grip portion is approximately one inch in diameter.

7. The golf club of claim 1, wherein the sliding grip portion is rotatable about the grip.

8. The golf club of claim 1, wherein the golf club is a wood.

9. The golf club of claim 1, wherein the golf club is a iron.

10. The golf club of claim 1, wherein the golf club is a putter.

11. An improved golf club comprising:

a head;

a grip;

a shaft connecting the grip to the head;

an upper grip portion of the grip, the upper grip portion including an upper stop and a lower stop;

a lower grip portion of the grip residing between the upper grip portion and the shaft; and a sliding grip portion adapted to slide on the upper grip portion, the sliding grip portion limited by the upper stop and the lower stop to a travel of approximately two inches to approximately three inches.

12. The gold club of claim 11, wherein the lower grip portion is constant diameter.

13. The gold club of claim 11, wherein the lower grip portion is tapered.

14. The gold club of claim 11, wherein the sliding grip slides longitudinally on the upper grip portion.

15. The gold club of claim 11, wherein the sliding grip rotates on the upper grip portion.

16. The gold club of claim 11, wherein the sliding grip slides longitudinally and rotates on the upper grip portion.

* * * * *